US006038861A

United States Patent [19]

Amos et al.

[11] Patent Number: 6,038,861

[45] Date of Patent: Mar. 21, 2000

[54] MAIN STAGE FUEL MIXER WITH PREMIXING TRANSITION FOR DRY LOW $NO_X$ (DLN) COMBUSTORS

[75] Inventors: David J. Amos; Mitchell O. Stokes, both of Orlando, Fla.

[73] Assignee: Siemens Westinghouse Power Corporation, Orlando, Fla.

[21] Appl. No.: 09/095,234

[22] Filed: Jun. 10, 1998

[51] Int. Cl.[7] ..... F02G 3/00

[52] U.S. Cl. ..... 60/737; 60/746; 60/748; 239/428

[58] Field of Search ..... 60/737, 740, 746, 60/39.36, 39.37, 748; 239/4 A, 423, 424, 428, 590, 590.3

[56] References Cited

U.S. PATENT DOCUMENTS

| | | | |
|---|---|---|---|
| 2,526,281 | 10/1950 | Ryan et al. | 60/39.37 |
| 3,643,430 | 2/1972 | Emory, Jr. et al. | 60/39.65 |
| 3,657,882 | 4/1972 | Hugoson | 60/39.37 |
| 4,098,075 | 7/1978 | Greenberg et al. | 60/39.36 |
| 5,207,064 | 5/1993 | Ciokajlo et al. | 60/737 |
| 5,351,475 | 10/1994 | Ansart et al. | 60/746 |
| 5,359,847 | 11/1994 | Pillsbury et al. | 60/737 |
| 5,901,549 | 5/1999 | Mandai et al. | 60/737 |
| 5,901,555 | 5/1999 | Mandai et al. | 60/737 |

*Primary Examiner*—Charles G. Freay
*Attorney, Agent, or Firm*—Eckert Seamans Cherin & Mellott, LLC

[57] ABSTRACT

A main stage fuel mixer that reduces $NO_x$ and CO emissions of a gas turbine combustor by providing a more homogeneous fuel/air mixture for main stage combustion is provided. A gas turbine combustor according to the present invention includes a nozzle housing having a nozzle housing base, a plurality of main nozzles, and a main stage fuel mixer. A main combustion zone is located adjacent to the nozzle housing. Each main nozzle extends through the nozzle housing and is attached to the nozzle housing base. The main stage fuel mixer has a plurality of inlets, each of which is adapted to receive a flow of gas, and an outlet adjacent to the main combustion zone. The main stage fuel mixer has a plurality of transition ducts, each associated with one inlet. Each transition duct provides fluid communication from the inlet associated with the transition duct to the outlet.

10 Claims, 6 Drawing Sheets

MAIN STAGE FUEL MIXER WITH PREMIXING TRANSITION FOR DRY LOW $NO_X$ (DLN) COMBUSTORS

FIELD OF THE INVENTION

The present invention relates to combustors for gas turbine engines. More specifically, the present invention relates to a main stage fuel mixer that reduces nitrogen oxide and carbon monoxide emissions produced by lean premix combustors.

BACKGROUND OF THE INVENTION

Gas turbines are known to comprise the following elements: a compressor for compressing air; a combustor for producing a hot gas by burning fuel in the presence of the compressed air produced by the compressor; and a turbine for expanding the hot gas produced by the combustor. Gas turbines are known to emit undesirable oxides of nitrogen ($NO_x$) and carbon monoxide (CO). One factor known to affect $NO_x$ emission is combustion temperature. The amount of $NO_x$ emitted is reduced as the combustion temperature is lowered. However, higher combustion temperatures are desirable to obtain higher efficiency and CO oxidation.

Two-stage combustion systems have been developed that provide efficient combustion and reduced $NO_x$ emissions. In a two-stage combustion system, diffusion combustion is performed at the first stage for obtaining ignition and flame stability. Premixed combustion is performed at the second stage to reduce $NO_x$ emissions.

The first stage, referred to hereinafter as the "pilot" stage, is normally a diffusion-type burner and is, therefore, a significant contributor of $NO_x$ emissions even though the percentage of fuel supplied to the pilot is comparatively quite small (often less than 10% of the total fuel supplied to the combustor). The pilot flame has thus been known to limit the amount of $NO_x$ reduction that could be achieved with this type of combustor. In a diffusion combustor, the fuel and air are mixed in the same chamber in which combustion occurs (i.e., a combustion chamber).

Pending U.S. patent application Ser. No. 08/759,395, assigned to the same assignee hereunder (the '395 application), discloses a typical prior art gas turbine combustor. As shown in FIG. 1 herein, combustor 100 comprises a nozzle housing 6 having a nozzle housing base 5. A diffusion fuel pilot nozzle 1, having a pilot fuel injection port 4, extends through nozzle housing 6 and is attached to nozzle housing base 5. A plurality of main nozzles 2, each having at least one main fuel injection port 3, extend substantially parallel to pilot nozzle 1 through nozzle housing 6 and are attached to nozzle housing base 5. Fuel inlets 16 provide fuel 102 to main nozzles 2. A main combustion zone 9 is formed within a liner 19. A pilot cone 20, having a diverged end 22, projects from the vicinity of pilot fuel injection port 4 of pilot nozzle 1. A pilot flame zone 23 is formed within pilot cone 20 adjacent to main combustion zone 9.

Compressed air 101 from compressor 50 flows between support ribs 7 through main fuel mixers 8. Each main fuel mixer 8 is substantially parallel to pilot nozzle 1 and adjacent to main combustion zone 9. Within each main fuel mixer 8, a plurality of flow turbulators 80, such as swirler vanes, generate air turbulence upstream of main fuel injection ports 3 to mix compressed air 101 with fuel 102 to form a fuel/air mixture 103. Fuel/air mixture 103 is carried into main combustion zone 9 where it combusts. Compressed air 101 also enters pilot flame zone 23 through a set of stationary turning vanes 10 located inside pilot swirler 11. Compressed air 101 mixes with pilot fuel 30 within pilot cone 20 and combusts in pilot flame zone 23.

FIG. 2A shows a radial cross-sectional view of prior art gas turbine combustor 100 taken along line A—A thereof. As shown in FIG. 2A, pilot nozzle 1 is surrounded by a plurality of main nozzles 2. Pilot swirler 11 surrounds pilot nozzle 1. A main fuel mixer 8 surrounds each main nozzle 2. Main fuel mixers 8 are separated from one another by a distance, d. In the embodiment shown in FIG. 2A, main fuel nozzles 2 are disposed uniformly around pilot nozzle 1. Consequently, distance, d, between adjacent main fuel mixers 8 is nearly the same for each pair of adjacent main fuel mixers 8, although it may be variable. Fuel/air mixture 103 flows through main fuel mixers 8 (out of the page) into main combustion zone 9 (not shown in FIG. 2A). Pilot swirler 11 forms an annulus 18 with liner 19. Compressed air 101 flows through annulus 18 (out of the page) into main combustion zone 9. Note that compressed air 101 flowing through annulus 18 is not premixed with any fuel.

FIG. 2B shows a radial cross-sectional view of prior art gas turbine combustor 100 taken along line B—B thereof. As shown in FIG. 1, line B—B is downstream of line A—A. Line B—B is adjacent to main combustion zone 9, downstream of main nozzles 2 and pilot nozzle 1. As shown in FIG. 2B, a plurality of main fuel mixers 8 are disposed uniformly around pilot swirler 11. Pilot swirler 11 forms an annulus 18 with liner 19. Compressed air 101 flows through annulus 18 (out of the page) into main combustion zone 9. Note that compressed air 101 in annulus 18 is not premixed with any fuel.

As shown in FIG. 2B, main fuel mixers 8 are separated from one another by distance, d. Although, as described above, distance, d, between adjacent main fuel mixers 8 may be variable or nearly constant, it is important to note that the distance between a given pair of main fuel mixers in FIG. 2B is substantially the same as the distance between the same pair of main fuel mixers 8 as shown in FIG. 2A. Thus, each main fuel mixer 8 is separated from every other main fuel mixer 8 and each main fuel mixer 8 is nearly constant in cross-sectional area along its length.

While gas turbine combustors such as the combustor disclosed in the '395 application have been developed to reduce $NO_x$ and CO emissions, current environmental concerns demand even greater reductions. It is known that leaner, more homogeneous fuel/air mixtures burn cooler and more evenly, thus decreasing $NO_x$ and Co emissions. Since, in a premix combustor, main stage fuel and compressed air are mixed in main stage fuel mixers before combustion occurs, there is a need in the art for a main stage fuel mixer that reduces $NO_x$ and CO emissions from gas turbine combustors by providing leaner, more homogeneous fuel/air mixtures for main stage combustion.

SUMMARY OF THE INVENTION

The present invention satisfies these needs in the art by providing a main stage fuel mixer that reduces $NO_x$ and CO emissions of a gas turbine combustor by providing a more homogeneous fuel/air mixture for main stage combustion.

A gas turbine combustor according to the present invention comprises a nozzle housing having a nozzle housing base, a plurality of main nozzles, and a main stage fuel mixer. A main combustion zone is located adjacent the nozzle housing. Each main nozzle has a main fuel injection port and extends through the nozzle housing and is attached to the nozzle housing base.

The main stage fuel mixer has a plurality of inlets. Each inlet is adapted to receive a flow of gas, such as compressed air. The main stage fuel mixer also has an outlet adjacent to the main combustion zone and a plurality of transition ducts. Each transition duct is associated with one inlet and provides fluid communication from the inlet associated with the transition duct to the outlet. In a preferred embodiment, the outlet is substantially annular. At least one main nozzle extends within one transition duct such that the main fuel injection port of the main nozzle is downstream of the inlet associated with the transition duct.

In a preferred embodiment, the plurality of transition ducts are substantially parallel to one another and disposed in circumferential relationship. Each transition duct has an inlet portion, an outlet portion, and a longitudinal axis. The inlet portion is substantially cylindrical and symmetric about the longitudinal axis of the transition duct. The outlet portion narrows radially and expands tangentially along the longitudinal axis such that each said transition duct merges with an adjacent transition duct.

A gas turbine combustor according to the present invention further comprises a plurality of flow turbulators. At least one such flow turbulator is disposed within at least one transition duct, downstream of the inlet associated with the transition duct. Each flow turbulator is adapted to turbulate the flow of gas within the main stage fuel mixer. In a preferred embodiment, a flow turbulator comprises a plurality of swirler vanes.

A gas turbine combustor according to the present invention further comprises a pilot nozzle, a pilot swirler, and a pilot cone. The pilot nozzle has a pilot fuel injection port and is disposed on an axial centerline of the gas turbine combustor, upstream of the main combustion zone. The pilot nozzle extends through the nozzle housing and is attached to the nozzle housing base. The pilot swirler has an axis that is substantially parallel to the pilot nozzle. The pilot swirler surrounds a portion of the pilot nozzle. The pilot cone projects from the vicinity of the pilot fuel injection port of the pilot nozzle and has a diverged end. The diverged end of the pilot cone is coupled to the outlet of the main stage fuel mixer.

DETAILED DESCRIPTION OF THE PREFERRED EMBODIMENT

Figure 3:
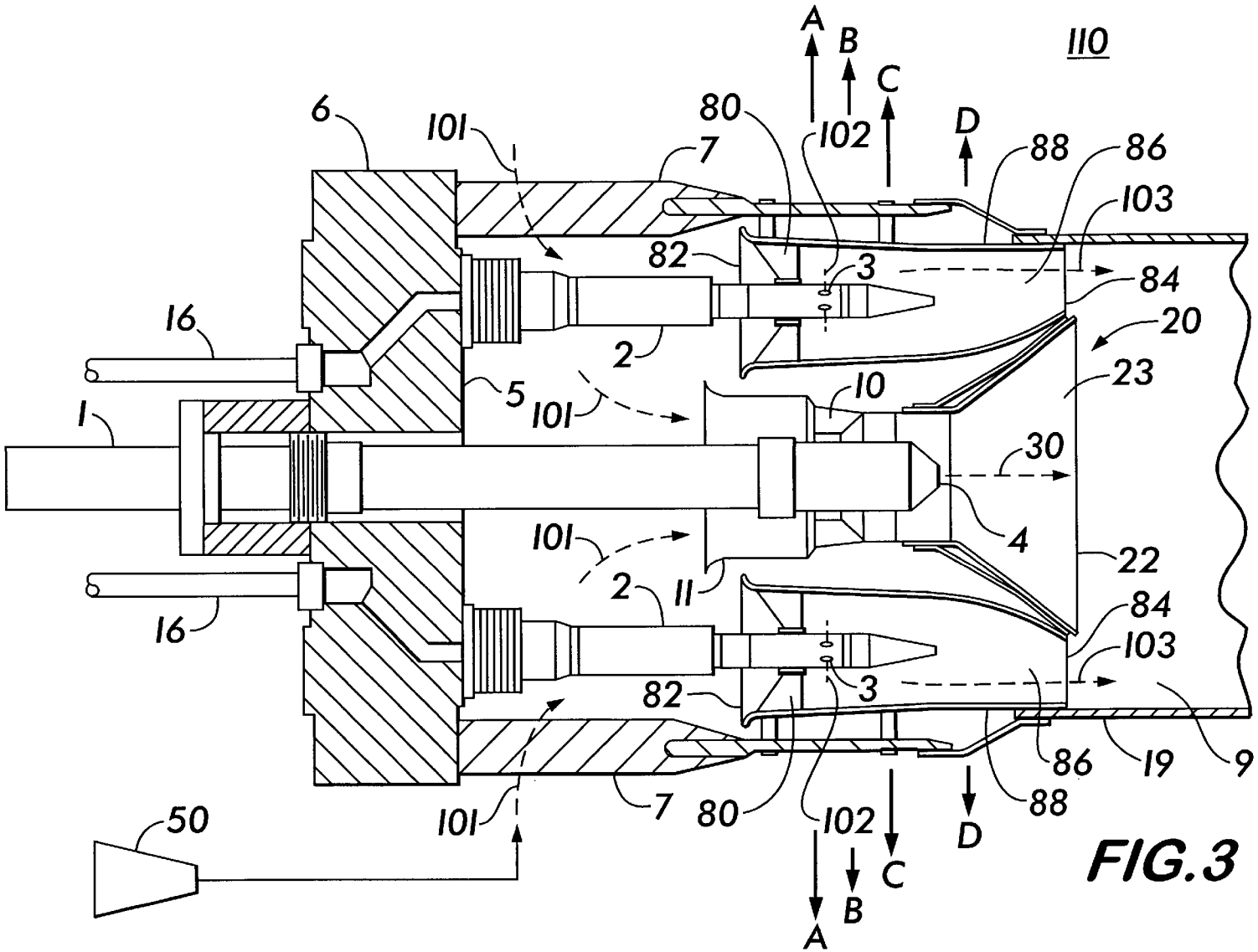
FIG. 3 shows an axial cross-sectional view of a preferred embodiment of a gas turbine combustor comprising a main stage fuel mixer according to the present invention.

FIG. 3 shows an axial cross-sectional view of a preferred embodiment of a gas turbine combustor 110 comprising a main stage fuel mixer 88 according to the present invention. As shown in FIG. 3, combustor 110 comprises a nozzle housing 6 having a nozzle housing base 5. A diffusion fuel pilot nozzle 1, having a pilot fuel injection port 4, is disposed along an axial centerline of gas turbine combustor 110 upstream of main combustion zone 9. Pilot nozzle 1 extends through nozzle housing 6 and is attached to nozzle housing base 5. A plurality of main nozzles 2, each having at least one main fuel injection port 3, extend substantially parallel to pilot nozzle 1 through nozzle housing 6 and are attached to nozzle housing base 5. Fuel inlets 16 provide fuel 102 to main nozzles 2. A main combustion zone 9 is formed within a liner 19. A pilot cone 20, having a diverged end 22, projects from the vicinity of pilot fuel injection port 4 of pilot nozzle 1. A pilot flame zone 23 is formed within pilot cone 20 adjacent to main combustion zone 9.

Compressed air 101 from compressor 50 flows between support ribs 7 and enters pilot flame zone 23 through a set of stationary turning vanes 10 located inside pilot swirler 11. Pilot swirler 11 surrounds a portion of pilot nozzle 1 and has an axis that is parallel to pilot nozzle 1. Compressed air 101 mixes with pilot fuel 30 within pilot cone 20 and is carried into pilot flame zone 23 where it combusts.

Compressed air 101 also flows into main stage fuel mixer 88. Main stage fuel mixer 88 has a plurality of inlets 82. Each inlet 82 is adapted to receive a flow of gas, such as compressed air 101. Main fuel mixer 88 has an outlet 84 adjacent to main combustion zone 9 and a plurality of transition ducts 86, each of which is associated with one inlet 82. Each transition duct provides fluid communication to outlet 84 from the inlet 82 associated with the transition duct 86. As shown in FIG. 3, outlet 84 is coupled to diverged end 22 of pilot cone 20.

One main nozzle 2 extends within each transition duct 86 such that the main fuel injection port 3 of each main nozzle 2 is downstream the inlet 82 associated with the transition duct 86. Thus, compressed air 101 enters main stage fuel mixer 88 through a plurality of inlets 82 and is mixed with fuel 102 in each transition duct 86 to form a fuel/air mixture 103 within each transition duct 86. Fuel/air mixture 103 is carried into main combustion zone 9 where it combusts.

In a preferred embodiment, main stage fuel mixer 88 also comprises a plurality of flow turbulators 80. One flow turbulator 80 is disposed within each transition duct 86 downstream of the inlet 82 associated with the transition duct 86. Flow turbulators 80 are adapted to turbulate the flow of compressed air 101 before it mixes with main fuel 102. This turbulence produces a more uniform fuel/air mixture 103. As shown in FIG. 3, each flow turbulator 80 comprises a plurality of swirler vanes. It is contemplated, however, that other flow turbulators, such as fuel/air mixing disks, may be used to turbulate the flow of compressed air 101 before it mixes with main fuel 102.

Figure 4:
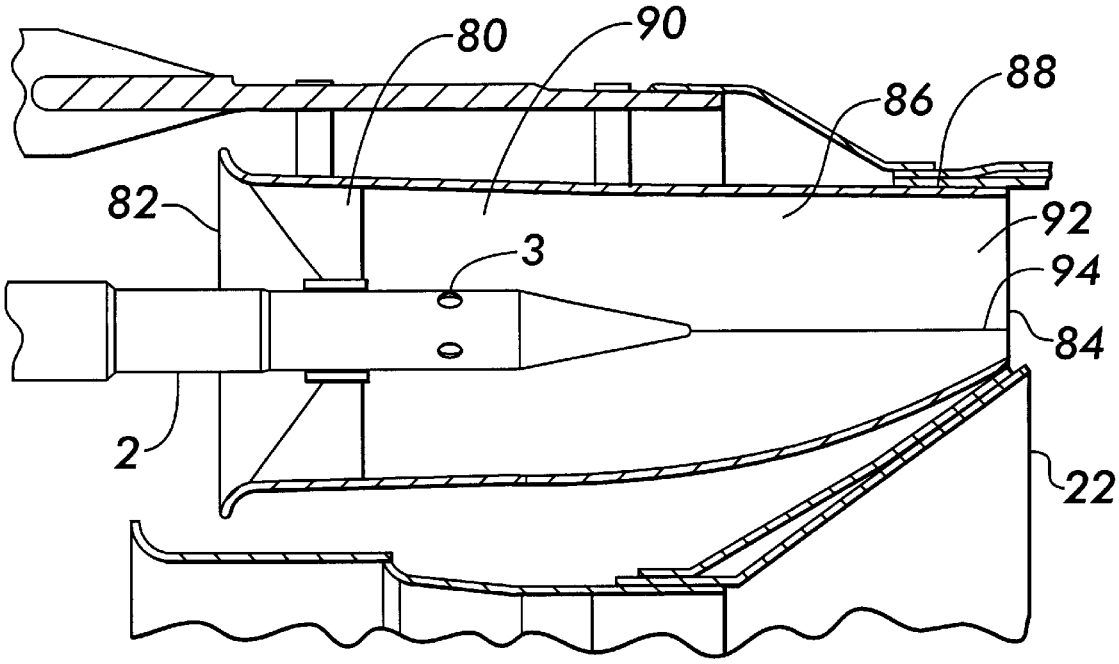
FIG. 4 shows an axial cross sectional view of a portion of a main stage fuel mixer 88 according to the present invention.

FIG. 4 shows an axial cross-sectional view of a portion of a main stage fuel mixer 88 according to the present invention. As shown in FIG. 4, transition duct 86 has an inlet portion 90, an outlet portion 92, and a longitudinal axis 94. In a preferred embodiment, inlet portion 90 is substantially cylindrical and symmetric about longitudinal axis 94. Outlet portion 92 narrows radially along longitudinal axis 94.

Figure 1:
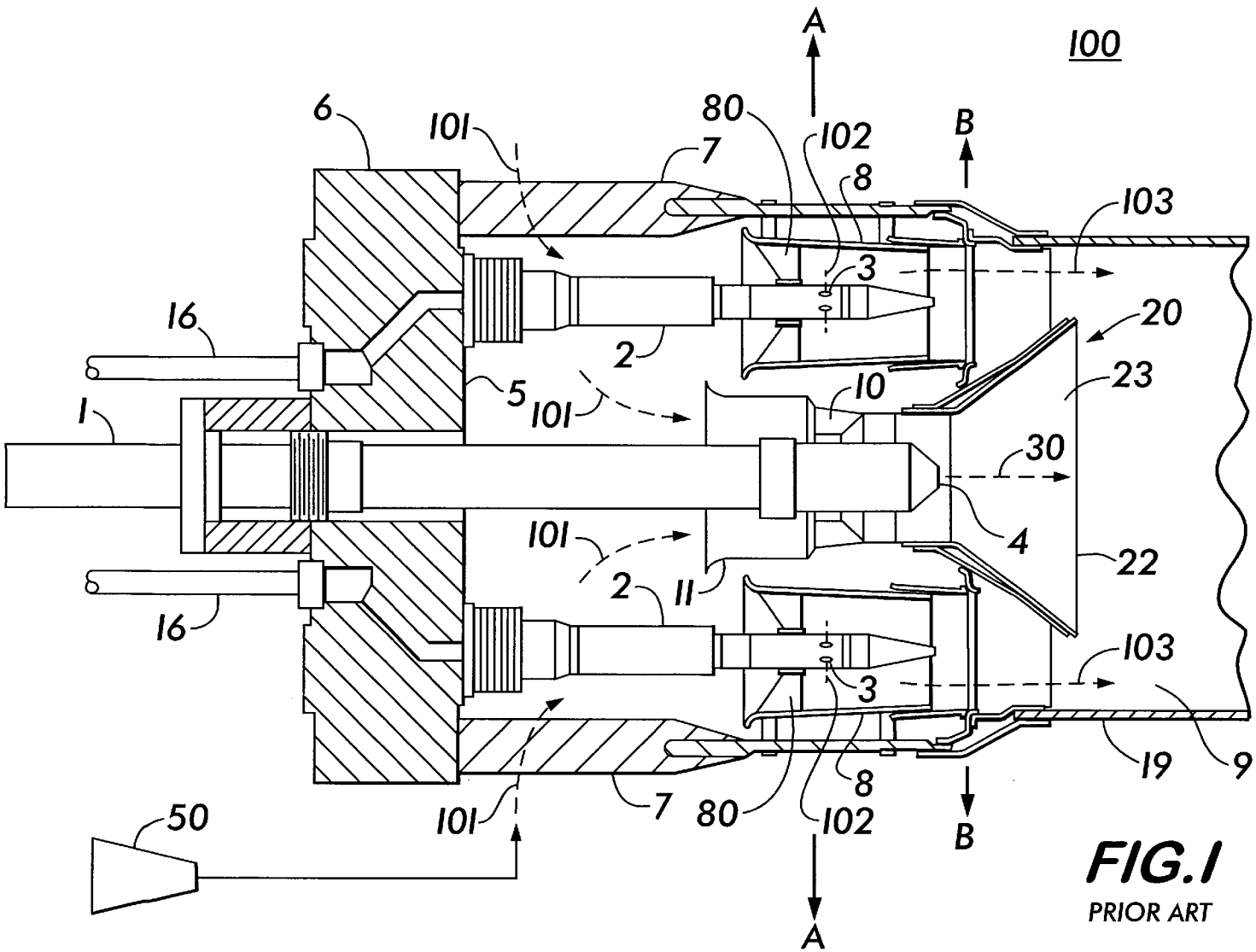
FIG. 1 PRIOR ART
FIG. 1 shows an axial cross-sectional view of a prior art gas turbine combustor.
Figure 2A:
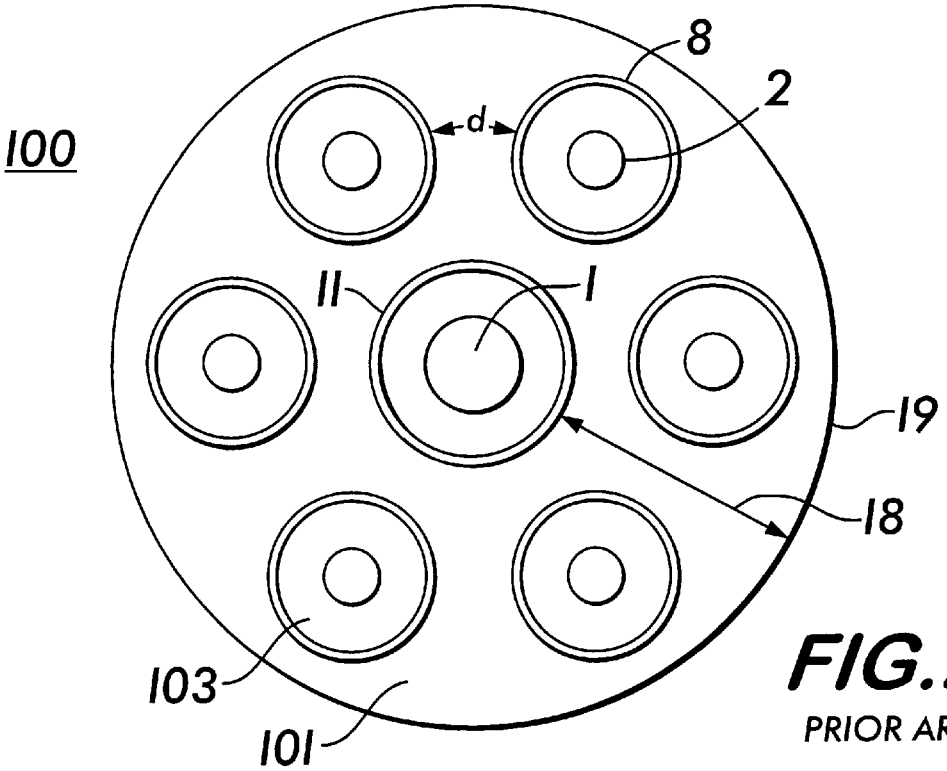
FIG. 2A PRIOR ART
FIGS. 2A and 2B show radial cross-sectional views of the prior art gas turbine combustor of FIG. 1 taken along lines A—A and B—B thereof, respectively.
Figure 2B:
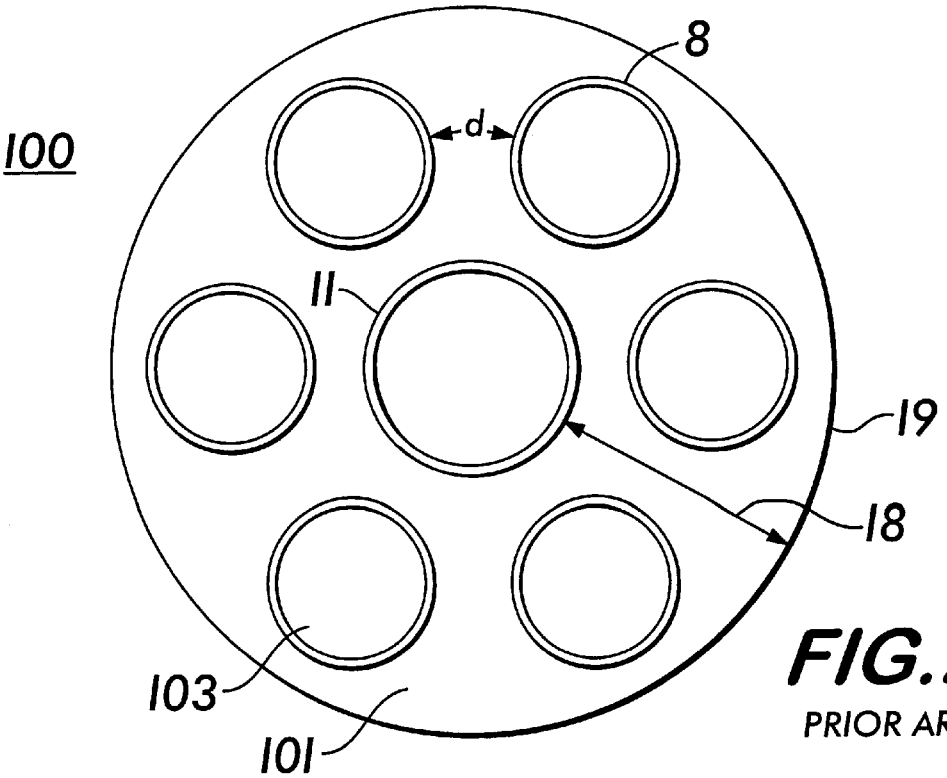
FIG. 2B PRIOR ART
Figure 5A:
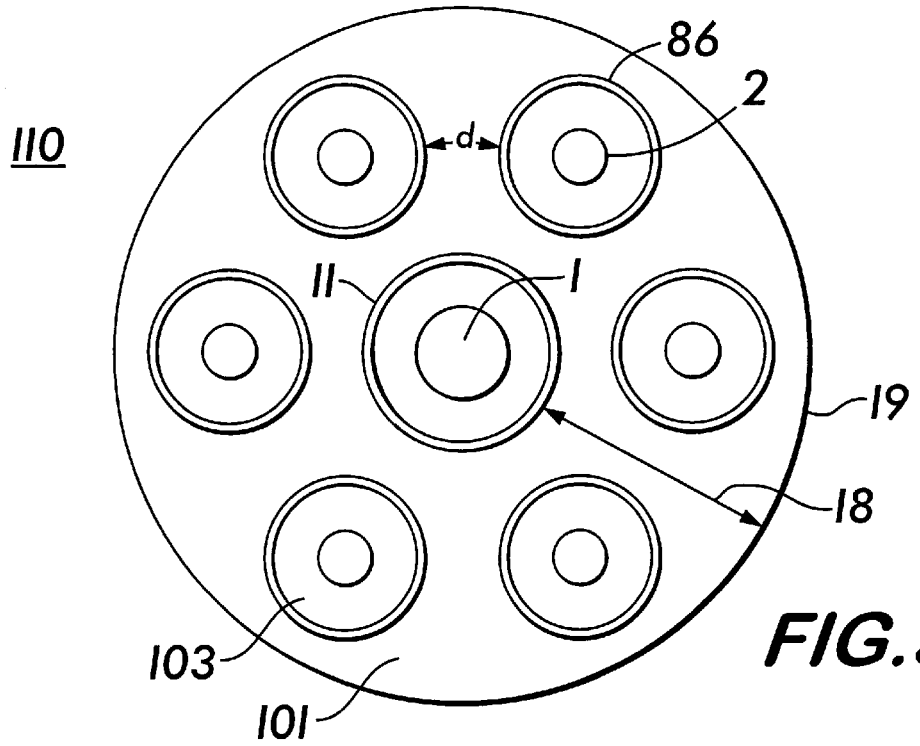
FIGS. 5A–5D show radial cross-sectional views of the gas turbine combustor of FIG. 3 taken along lines A—A, B—B, C—C, and D—D thereof, respectively.

FIGS. 5A—5D show radial cross-sectional views of the gas turbine combustor of FIG. 3 taken along lines A—A, B—B, C—C, and D—D thereof, respectively. Line A—A is drawn through inlet portion 90 of transition duct 86 perpendicular to longitudinal axis 94. As shown in FIG. 5A, transition duct 86 has a circular cross section. By comparing FIG. 5A with FIG. 2A, it can be seen that a cross-section of gas turbine combustor 110 taken through inlet portion 90 is substantially the same as a cross-section of prior art gas turbine combustor 100 taken at the same point.

Figure 5B:
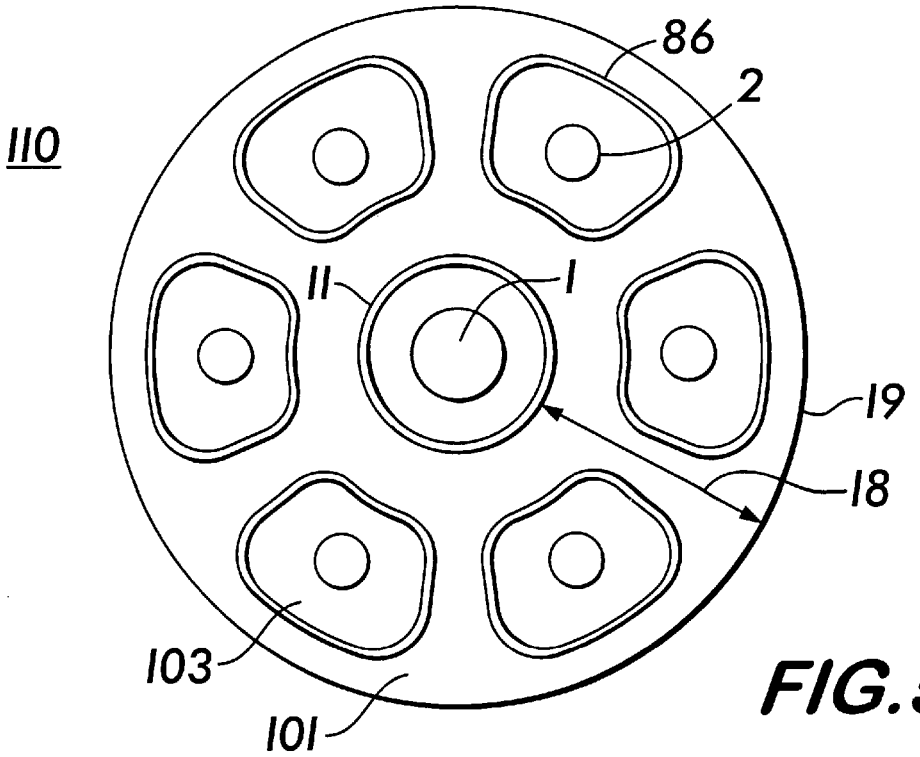
Figure 5C:
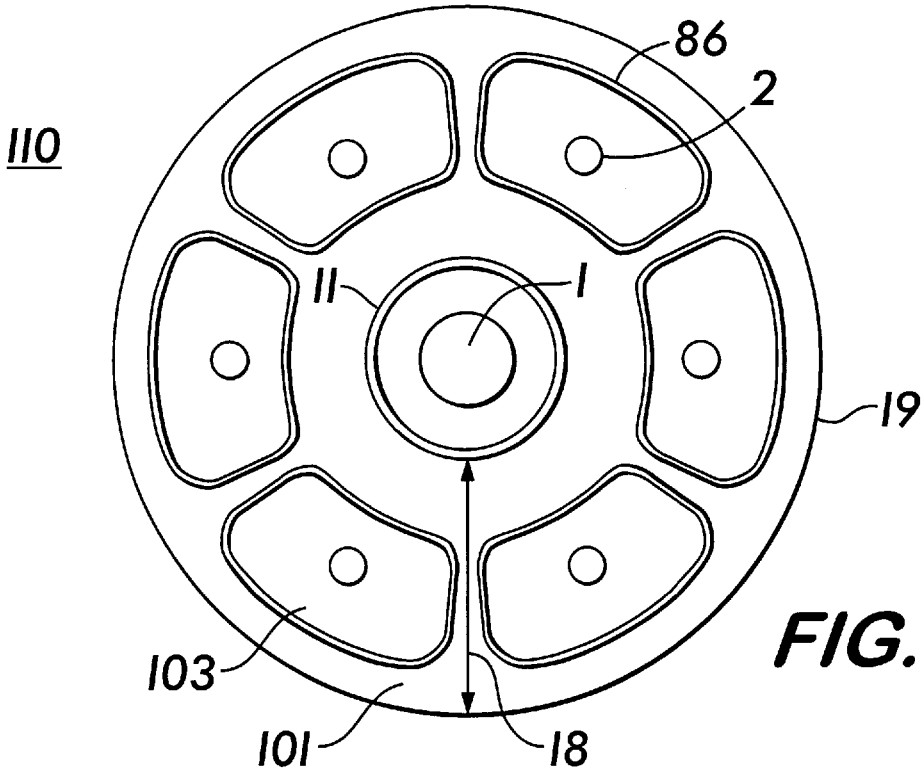
Figure 5D:
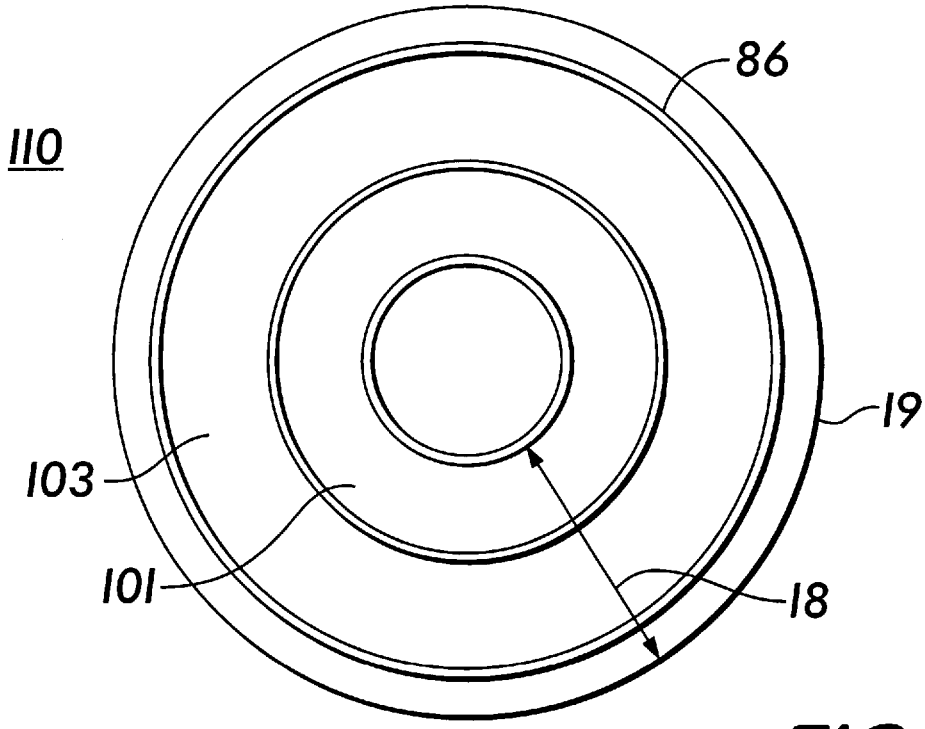

Lines B—B, C—C, and D—D, however, are drawn through outlet portions 92 of transition ducts 86 at various points along longitudinal axis 94 and are perpendicular thereto. As shown in FIGS. 5B, 5C, and 5D taken together, transition ducts 86 expand tangentially along longitudinal axis 94. In a preferred embodiment, the plurality of transition ducts 86 are substantially parallel to one another and disposed in circumferential relationship. In such a relationship, transition ducts 86 expand until each transition duct 86 merges with the adjacent transition ducts 86, forming an annulus as shown in FIG. 5D.

Figure 6:
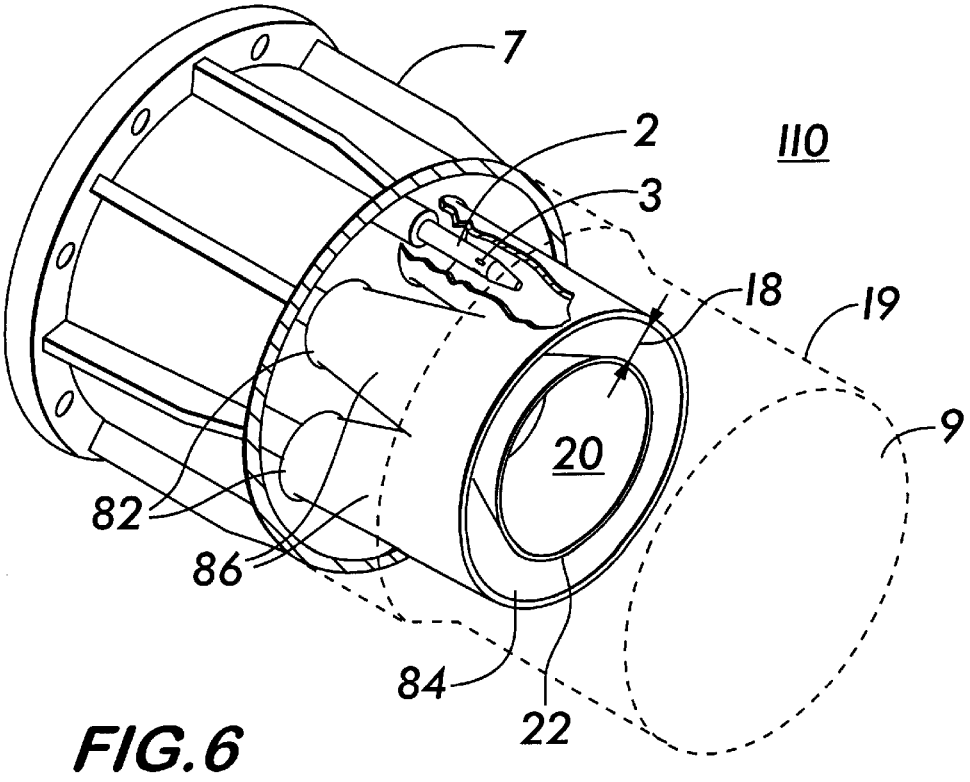
FIG. 6 shows a perspective view of a preferred embodiment of a gas turbine combustor comprising a main stage fuel mixer according to the present invention.

Fuel/air mixture 103 flows through transition ducts 86 (out of the page) into main combustion zone 9 (not shown in FIGS. 5A–5D). Pilot swirler 11 forms an annulus 18 with liner 19. In contradistinction to the prior art combustor, compressed air 101 is trapped within annulus 18 and cannot flow into main combustion zone 9. Note that compressed air 101 trapped within annulus 18 is not premixed with any fuel. As transition ducts 86 expand tangentially along longitudinal axis 94, the amount of compressed air 101 trapped within annulus 18 is reduced, until (as best seen in FIG. 6) all that flows out of annulus 18 into main combustion zone 9 is fuel/air mixture 103. By eliminating the flow of compressed air 101 into main combustion zone 9, main stage fuel mixer 88 of the present invention ensures a more homogeneous fuel/air mixture within combustion zone 9.

FIG. 6 shows a perspective view of a preferred embodiment of a gas turbine combustor 110 comprising a main stage fuel mixer 88 according to the present invention. As shown in FIG. 6, gas turbine combustor 110 comprises a main stage fuel mixer 88 having a plurality of inlets 82 and an outlet 84. Each inlet 82 is adapted to receive a flow of gas. Main stage fuel mixer 88 has a plurality of transition ducts 86. Each transition duct 86 is associated with one inlet 82 and provides fluid communication from the associated inlet 82 to outlet 84. Outlet 84 is adjacent to main combustion zone 9.

As shown in FIG. 6, the plurality of transition ducts 86 are substantially parallel to one another and disposed in circumferential relationship. One main nozzle 2 extends within each transition duct 86 such that the main fuel injection port 3 of each main nozzle 2 is downstream of the associated inlet 82. Each transition duct 86 narrows radially and expands tangentially, such that each transition duct 86 merges with the adjacent transition ducts 86. Thus, as shown in FIG. 6, outlet 84 is annular in shape. Diverged end 22 of pilot cone 20 is coupled to outlet 84 as shown. In the embodiment shown in FIG. 6, only fuel/air mixture 103 flows into main combustion zone 9. The absence of compressed air 101 in main combustion zone 9 causes a much more uniform fuel/air mixture for main stage combustion.

Main stage fuel mixer 88 reduces the $NO_x$ and CO emissions produced by gas turbine combustor 110 by improving the mixing of main fuel and compressed air 101 to form fuel air mixture 103. Transition ducts 86 eliminate the cooling air 101 that exists between main fuel mixers 8 as in the prior art combustor 100. Thus, fuel/air mixture 103 is better mixed (i.e., more homogeneous) in combustor 110 than in prior art combustor 100.

Additionally, since the size of outlet 84 can be varied, combustor 110 provides more control over the velocity of the flow of fuel/air mixture 103 into main combustion zone 9 than does prior art combustor 100. Control over the velocity of the flow prior to combustion is important to the prevention of flashback into the main stage fuel mixer.

Those skilled in the art will appreciate that numerous changes and modifications may be made to the preferred embodiments of the invention and that such changes and modifications may be made without departing from the spirit of the invention. It is therefore intended that the appended claims cover all such equivalent variations as fall within the true spirit and scope of the invention.

We claim:

1. A gas turbine combustor, comprising:

a nozzle housing, said nozzle housing having a nozzle housing base, a main combustion zone located adjacent to said nozzle housing;

a plurality of main nozzles, each said main nozzle extending through said nozzle housing and attached to said nozzle housing base; and a main stage fuel mixer, said main stage fuel mixer having a plurality of inlets, each said inlet adapted to receive a flow of gas, said main stage fuel mixer having an outlet adjacent to said main combustion zone, said main stage fuel mixer having a plurality of transition ducts, each said transition duct associated with one said inlet, each said transition duct providing fluid communication from the inlet associated with said transition duct to said outlet.

2. The gas turbine combustor of claim 1, wherein each said main nozzle has a main fuel injection port, and wherein one said main nozzle extends within one said transition duct such that the main fuel injection port of said one main nozzle is downstream of the inlet associated with said transition duct.

3. The gas turbine combustor of claim 1, wherein said main stage fuel mixer further comprises:

a plurality of flow turbulators, wherein one said flow turbulator is disposed within one said transition duct downstream of the inlet associated with said one transition duct, and wherein each said flow turbulator is adapted to turbulate said flow of gas.

4. The gas turbine combustor of claim 1, wherein said flow turbulator comprises a plurality of swirler vanes.

5. The gas turbine combustor of claim 1, wherein said gas is compressed air.

6. The gas turbine combustor of claim 1, wherein said outlet is substantially annular.

7. The gas turbine combustor of claim 6, further comprising:

a pilot nozzle having a pilot fuel injection port, said pilot nozzle disposed on an axial centerline of said gas turbine combustor upstream of the main combustion zone, said pilot nozzle extending through said nozzle housing and attached to the nozzle housing base;

a pilot swirler having an axis, the axis of said pilot swirler substantially parallel to said pilot nozzle, said pilot swirler surrounding a portion of said pilot nozzle; and a pilot cone having a diverged end, said pilot cone projecting from the vicinity of the pilot fuel injection port of said pilot nozzle, the diverged end of said pilot cone coupled to the outlet of said main stage fuel mixer.

8. The gas turbine combustor of claim 1, wherein at least one said transition duct has an inlet portion, an outlet portion, and a longitudinal axis, and wherein said inlet portion is substantially cylindrical and symmetric about the longitudinal axis of said transition duct, and wherein said outlet portion narrows radially along the longitudinal axis of said transition duct, and wherein said outlet portion expands tangentially along the longitudinal axis of said transition duct.

9. The gas turbine combustor of claim 1, wherein said plurality of transition ducts are substantially parallel to one another and disposed in a circumferential relationship relative to a combustor longitudinal axis.

10. The gas turbine combustor of claim 9, wherein each transition duct of said plurality of transition ducts has an inlet portion, an outlet portion, and a longitudinal axis, and wherein the inlet portion of each said transition duct is substantially cylindrical and symmetric about the longitudinal axis of said transition duct, and wherein the outlet portion of each said transition duct narrows radially along the longitudinal axis of said transition duct, and wherein each said outlet portion expands tangentially along the longitudinal axis of said transition duct, such that each said transition duct merges with an adjacent transition duct.

* * * * *